US010156340B1

(12) United States Patent
Du

(10) Patent No.: US 10,156,340 B1
(45) Date of Patent: Dec. 18, 2018

(54) LAMPSHADE AND LAMP PROTECTION STRUCTURE

(71) Applicant: Dong Guan Unigarden Company Ltd., Dong Guan (CN)

(72) Inventor: Min Du, Shenzhen (CN)

(73) Assignee: Dong Guan Unigarden Company Ltd., Dong Guan (CN)

( * ) Notice: Subject to any disclaimer, the term of this patent is extended or adjusted under 35 U.S.C. 154(b) by 0 days.

(21) Appl. No.: 15/858,439

(22) Filed: Dec. 29, 2017

(51) Int. Cl.

| | |
|---|---|
| ***F21V 9/08*** | (2018.01) |
| ***F21V 1/04*** | (2006.01) |
| ***F21V 15/01*** | (2006.01) |
| ***F21V 17/16*** | (2006.01) |

(52) U.S. Cl.
CPC ..... *F21V 1/04* (2013.01); *F21V 15/01* (2013.01); *F21V 17/164* (2013.01)

(58) Field of Classification Search
CPC ..... F21V 1/04; F21V 15/01; F21V 17/164
USPC ..... 362/351
See application file for complete search history.

(56) References Cited

U.S. PATENT DOCUMENTS

| | | | | |
|---|---|---|---|---|
| 4,539,631 A * | 9/1985 | Lieberman | F21V 1/00 | 362/351 |
| 5,491,616 A * | 2/1996 | Reed | F21V 1/10 | 362/35 |
| 8,931,192 B2 * | 1/2015 | Acworth | F21S 6/002 | 40/554 |

* cited by examiner

*Primary Examiner* — Karl D Frech
(74) *Attorney, Agent, or Firm* — Wang Law Firm, Inc.

(57) ABSTRACT

A lampshade and lamp protection structure comprises a lampshade and a lamp base disposed therein. The lampshade has inside a snap ring, along which are provided with several connecting rods connected thereon. The other end of each connecting rod is connected to the cover body. The lamp base comprises a base body, whose top is provided with a snap base with a top surface having several claws. The inner side of the top of each claw has a barb matching the snap ring. The snap ring is inserted between the claws for the barbs to hold. The lamp base is connected to the snap ring through the snap base, and requires a tool to release. The lampshades of displayed lamps in a sale cannot be removed or interchanged easily. The wire therein is prevented from damages as it does not rotate when the lampshade and lamp base are separated.

3 Claims, 3 Drawing Sheets

LAMPSHADE AND LAMP PROTECTION STRUCTURE

FIELD OF THE INVENTION

The invention relates to a lamp and, in particular, to a lampshade and lamp protection structure.

BACKGROUND OF THE INVENTION

Lampshades are generally mounted on lamps to converge light. They also prevent users from electric shocks and protect users' eyes against strong light. In the prior art, a lamp base is usually used for the installation of a light bulb. The lampshade is provided with a metal ring directly mounted on the outer wall of the lamp base. Alternatively, a screw thread is arranged on the outer wall of the lamp base. A plastic accessory is then used to fasten the lampshade base onto the lamp base.

With the above structure in the prior art, the structure of mounting the lampshade onto the lamp base and the match between the plastic accessory and the screw thread makes it easy to take the lampshade off, thereby resulting in a series of potential safety problems. For example, in a sale the lampshade and the lamp base of the lamp products displayed in the display area may be arbitrarily taken off by consumers at will. This may scratch or damage the lampshade easily. This may also cause the lamp base and the light bulb to drop and break. When the lampshade is removed, continuous rotations of the lamp base thread structure can easily damage the wire.

SUMMARY OF THE INVENTION

In view of the foregoing, the invention provides a lampshade and lamp protection structure.

The disclosed lampshade and lamp protection structure includes a lampshade and a lamp base disposed inside the lampshade, wherein the lampshade includes a shade body with a snap ring provided therein; a plurality of evenly distributed connecting rods are provided along the snap ring, with one end of each of the connecting rods connecting to the snap ring and the other end thereof connecting to the shade body; the lamp base includes a base body whose top has a snap base; a plurality of evenly distributed claws are provided along the rim of the top surface of the snap base; the inner side of the top of each of the claws is provided with a barb corresponding to the snap ring; and the snap ring is inserted between the claws in such a way that the barbs of the claws hold the snap ring.

In comparison with the prior art, the disclosed lampshade and lamp protection structure has the following advantages.

The lamp base is connected to the snap ring of the lampshade through the snap base, and requires a special tool to be released. Therefore, the lampshades of the lamps displayed in the product display area cannot be removed or interchanged easily. This reduces the risk of damages before sale. Moreover, the wire inside is prevented from damages as it does not rotate when one separates the lampshade and the lamp base.

DESCRIPTION OF THE PREFERRED EMBODIMENTS

The aforementioned and other objectives and advantages of this disclosure will become clearer in light of the following detailed description of an illustrative embodiment of this invention described in connection with the drawings.

Figure 1:
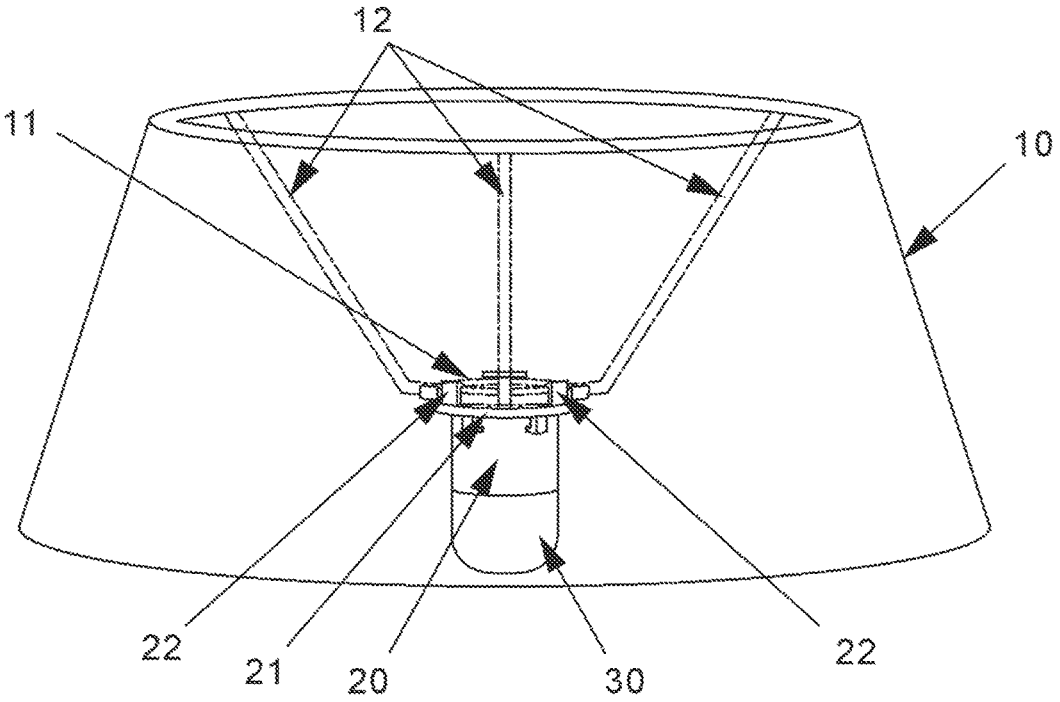
FIG. 1 is a schematic view of the invention.
Figure 2:
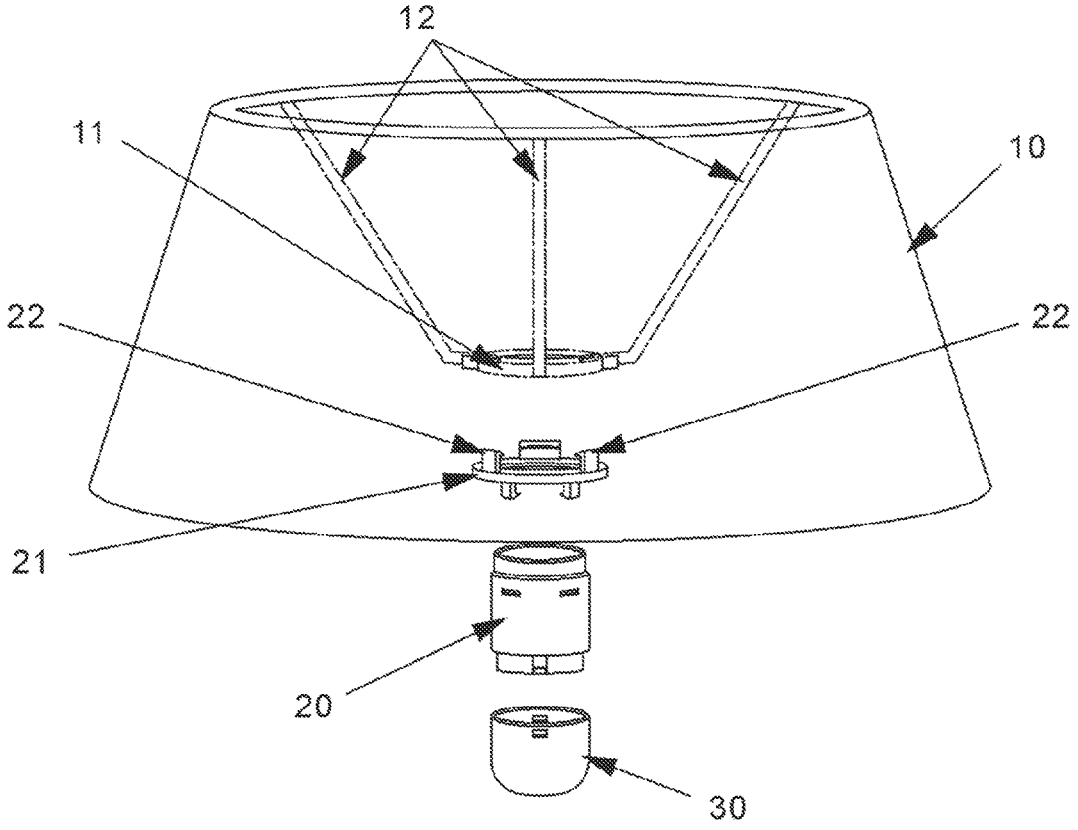
FIG. 2 is a schematic exploded view of the invention.
Figure 3:
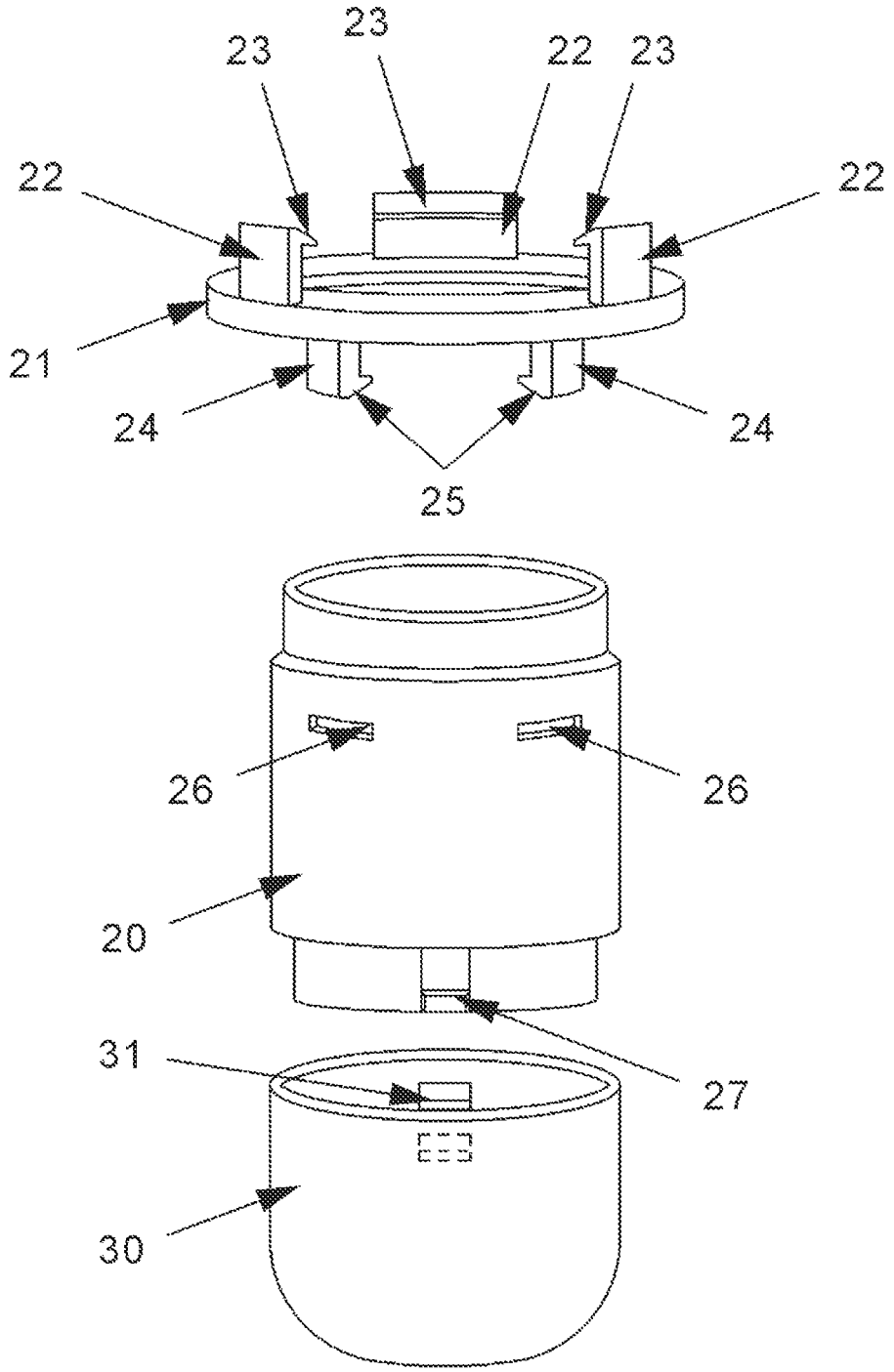
FIG. 3 is a schematic view of the disclosed lamp base.

As shown in FIGS. 1 to 3, the disclosed lampshade and lamp protection structure includes a lampshade and a lamp base disposed therein. The lampshade includes a shade body 10 with a snap ring 11 provided therein. A plurality of evenly distributed connecting rods 12 are provided along the snap ring 11, with one end of each of the connecting rods 12 connecting to the snap ring 11 and the other end thereof connecting to the shade body 10. The lamp base includes a base body 20 whose top has a snap base 21. A plurality of evenly distributed claws 22 are provided along the rim of the top surface of the snap base 21. The inner side of the top of each of the claws 22 is provided with a barb 23 corresponding to the snap ring 11. The snap ring 11 is inserted between the claws 22 in such a way that the barbs 23 of the claws 22 hold the snap ring 11.

According to the above-mentioned structure, the lamp base is connected to the snap ring of the lampshade through the snap base, and requires a special tool to be released. Therefore, the lampshades of the lamps displayed in the product display area cannot be removed or interchanged easily. This reduces the risk of damages before sale. Moreover, the wire inside is prevented from damages as it does not rotate when one separates the lampshade and the lamp base.

The snap base 21 is integrally formed, with the bottom surface thereof provided with a plurality of evenly distributed clip claws 24. The inner side of the tail of each of the clip claws 24 has a hook 25. A groove 26 corresponding to the clip claws 24 is formed around the head part of the base body 20. The head part of the base body 20 is inserted between the clip claws 24 and the hooks 25 of the clip claws 24 engage with the groove 26 to hold the head part of the base body 20.

A lower cover 30 is further provided to the bottom part of the lamp base. A plurality of evenly distributed buckling points 27 are formed along the lower rim of the base body 20. A buckling groove 31 corresponding to the buckling points 27 is formed on the inner ring of the top part of the lower cover 30. The lower end of the base body 20 is embedded inside the lower cover 30, with the buckling points 27 engaged with the buckling groove 31. With the protection of the lower cover for the base body, damages to the internal structure of the lamp base are prevented. This reduces the risk of damages to the lamps before sale.

While the invention is described in some detail hereinbelow with reference to certain illustrated embodiments, it is to be understood that there is no intent to limit it to those embodiments. On the contrary, the aim is to cover all modifications, alternatives and equivalents falling within the spirit and scope of the invention as defined by the appended claims.

What is claimed is:

1. A lampshade and lamp protection structure, comprising a lampshade and a lamp base disposed inside the lampshade, wherein the lampshade includes a shade body with a snap ring provided therein;

a plurality of evenly distributed connecting rods are provided along the snap ring, with one end of each of the connecting rods connecting to the snap ring and the other end thereof connecting to the shade body;

the lamp base includes a base body having a head part whose top has a snap base with a top surface and a bottom surface, wherein the snap base is integrally formed;

a plurality of evenly distributed claws are provided along the rim of the top surface of the snap base;

the inner side of the top of each of the claws is provided with a barb corresponding to the snap ring the snap ring is inserted between the claws in such a way that the barbs of the claws hold the snap ring, a plurality of evenly distributed clip claws are provided along the bottom surface of the snap base;

the inner side of each of the clip claws has a hook;

a groove corresponding to the clip claws is formed around the head part of the base body, and the head part of the base body is inserted between the clip claws and the hooks of the clip claws engage with the groove to hold the head part of the base body.

2. The lampshade and lamp protection structure of claim 1, wherein a lower cover is provided to the bottom part of the lamp base; a plurality of evenly distributed buckling points are formed along the lower rim of the base body; a buckling groove corresponding to the buckling points is formed on the inner ring of the top part of the lower cover; and the lower end of the base body is embedded inside the lower cover, with the buckling points engaged with the buckling groove.

3. The lampshade and lamp protection structure of claim 1, wherein a lower cover is provided to the bottom part of the lamp base; a plurality of evenly distributed buckling points are formed along the lower rim of the base body; a buckling groove corresponding to the buckling points is formed on the inner ring of the top part of the lower cover; and the lower end of the base body is embedded inside the lower cover, with the buckling points engaged with the buckling groove.

* * * * *